US006943283B2

(12) United States Patent
McPherson

(10) Patent No.: US 6,943,283 B2
(45) Date of Patent: Sep. 13, 2005

(54) BRACING SYSTEM FOR STRINGED INSTRUMENT

(76) Inventor: Mathew McPherson, 19055 Incline Rd., Route 2, P.O. Box 58, Norwalk, WI (US) 54648

( * ) Notice: Subject to any disclaimer, the term of this patent is extended or adjusted under 35 U.S.C. 154(b) by 257 days.

(21) Appl. No.: 10/317,601

(22) Filed: Dec. 11, 2002

(65) Prior Publication Data

US 2003/0154843 A1 Aug. 21, 2003

Related U.S. Application Data

(60) Provisional application No. 60/339,858, filed on Dec. 12, 2001.

(51) Int. Cl.[7] ..... G10D 3/00

(52) U.S. Cl. ..... 84/291; 84/290

(58) Field of Search ..... 84/290, 267, 227, 84/274, 275, 276, 277; 248/443, 444

(56) References Cited

U.S. PATENT DOCUMENTS

| | | | | | |
|---|---|---|---|---|---|
| 635,872 | A | | 10/1899 | Scmidtlein | |
| 1,747,307 | A | | 2/1930 | Leland et al. | |
| 1,959,530 | A | | 5/1934 | Gerber | |
| 2,523,963 | A | | 9/1950 | Mitchell | 84/267 |
| 3,539,699 | A | | 11/1970 | Johnson | 84/1.16 |
| 3,869,954 | A | | 3/1975 | Ito | 84/291 |
| 3,974,730 | A | * | 8/1976 | Adams, Jr. | 84/291 |
| 4,056,034 | A | | 11/1977 | Kaman | 84/267 |
| 4,079,654 | A | | 3/1978 | Kasha | 84/291 |
| 4,090,427 | A | | 5/1978 | Kaman | 84/291 |
| 4,178,827 | A | | 12/1979 | Mallory | 84/291 |
| 4,291,606 | A | | 9/1981 | Lepage | 84/291 |
| 4,317,402 | A | | 3/1982 | McPherson, Sr. | 84/291 |
| 4,320,684 | A | | 3/1982 | Podunavac | 84/291 |
| D270,735 | S | | 9/1983 | McPherson, Sr. | D17/20 |
| 4,407,181 | A | | 10/1983 | Thomas | 84/275 |
| 4,467,692 | A | | 8/1984 | Egan | 84/291 |
| 4,681,009 | A | | 7/1987 | Mouradian | 84/293 |
| 4,796,504 | A | | 1/1989 | McWillis | 84/265 |
| 4,836,076 | A | | 6/1989 | Bernier | 84/275 |
| 4,846,039 | A | | 7/1989 | Mosher | 84/293 |
| 4,873,907 | A | | 10/1989 | Decker, Jr. et al. | 84/291 |
| 4,877,070 | A | | 10/1989 | Hayashi | 144/364 |
| 4,941,389 | A | | 7/1990 | Wendler | 84/727 |
| 5,170,000 | A | | 12/1992 | Hayashida et al. | 84/192 |
| 5,171,926 | A | | 12/1992 | Besnainou et al. | 84/275 |
| 5,320,018 | A | | 6/1994 | Fandrich | 84/195 |
| 5,333,527 | A | | 8/1994 | Janes et al. | 84/291 |
| 5,406,874 | A | * | 4/1995 | Witchel | 84/291 |
| 5,461,958 | A | | 10/1995 | Dresdner et al. | 84/267 |
| 5,469,770 | A | * | 11/1995 | Taylor | 84/291 |
| 5,585,579 | A | | 12/1996 | Ignatius | 84/192 |
| 5,952,592 | A | | 9/1999 | Teel | 84/291 |
| 5,990,396 | A | | 11/1999 | Lasner | 84/293 |
| 6,100,458 | A | | 8/2000 | Carrington | 84/293 |
| 6,166,308 | A | | 12/2000 | Lam | 84/291 |
| 6,627,803 | B1 | * | 9/2003 | Stephens | 84/267 |
| 2002/0005105 | A1 | | 1/2002 | McPherson | 84/291 |
| 2002/0043146 | A1 | | 4/2002 | McPherson | 84/291 |

FOREIGN PATENT DOCUMENTS

| | | |
|---|---|---|
| WO | 01/56011 | 8/2001 |

* cited by examiner

*Primary Examiner*—Kimberly Lockett
(74) *Attorney, Agent, or Firm*—Vidas, Arrett & Steinkraus

(57) ABSTRACT

In accordance with the invention, a sound box for an instrument is provided exhibiting a 3-D bracing system. The bracing system comprises a plurality of braces on both the sound board and the bottom board of the sound box. The braces exhibit varying heights and configurations to, among other things, increase the strength without increasing the weight unnecessarily.

45 Claims, 15 Drawing Sheets

BRACING SYSTEM FOR STRINGED INSTRUMENT

RELATIONSHIP TO OTHER APPLICATIONS

The present application claims priority to U.S. Provisional Application Ser. No. 60/339858, Filed Dec. 12, 2001 which is herein incorporated by reference in its entirety.

FIELD OF THE INVENTION

The present invention relates to an acoustic guitar or other instrument having a sound box, and more particularly, the present invention relates to a unique bracing structure for the sound box.

BACKGROUND OF THE INVENTION

A typical acoustic guitar has a hollow body or sound box connected to a neck. The hollow body has a soundboard with a sound hole, a back or bottom board spaced from the soundboard, and a shaped side wall which connects between the soundboard and backboard. Typically, these components are constructed of choice pieces of wood in order to produce instruments of superior quality.

The acoustic guitar has a series of strings strung at substantial tension from a bridge on the soundboard, across the sound hole, and along the neck. The string tension creates forces which act on the soundboard and which, over time, can cause bending, cracking or other damage to the soundboard. The damage can result in structural failure and altered intonation of the acoustic guitar. As such, the guitar, notably the sound box, must be constructed in a relatively strong and stable manner, without making it to heavy or limiting its response.

In high quality acoustic guitars, the soundboard must be capable of sufficient vibration to provide superior acoustic performance while being sufficiently rigid so that it withstands the forces created by the tensioned strings. These requirements are at cross-purposes, and heretofore have been very difficult to achieve, particularly when the soundboard is constructed from a material other than choice wooden materials. The sound board is in close union with the remaining pieces of the sound box. As such, to achieve the desired high qualities, one must also address these features as well.

Prior art designs have attempted to improve upon the strength and durability of acoustic guitars without adversely affecting its playing qualities. For example, U.S. Pat. No. 5,461,958 issued to Dresdner et al. and assigned to the assignee of the present application discloses an acoustic guitar assembly having a wooden soundboard with an improved soundboard bracing structure and an improved neck to body joint.

Acoustic guitars are constructed so as to amplify the sound wave produced by the vibration of the strings, via a resonance body having a sound board. The sound wave created by the vibrating strings is introduced into the resonance body through the bridge provided on the sound board. Inside the resonance body, the sound wave is resounded and amplified within the resonance body. If the resonance body is not constructed correctly, the sound may be emitted in a muffled or dampened manner.

The present invention provides for a uniformly strong sound box which delivers clean, brilliant sound. The construction of the box provides for easier and more economical manufacture when state of the art equipment is used.

All U.S. patents and applications all other published documents mentioned anywhere in this application are incorporated herein by reference in their entirety.

Without limiting the scope of the invention in any way, the invention is briefly summarized in some of its aspects below.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

SUMMARY OF THE INVENTION

In accordance with the invention, a sound box for an instrument is provided exhibiting a 3-D bracing system. The bracing system comprises a plurality of braces on both the sound board and the bottom board of the sound box. The braces exhibit varying heights and configurations to, among other things, increase the strength without increasing the weight unnecessarily.

The braces of the sound board and the bottom board are effectively interconnected via vertical struts attached to the inside of the side wall. The braces and struts are interconnected without any glue joints between the different braces or struts. The interconnections preserve the desired strength without increasing the rigidity. Further, in sound boxes where braces are connected and where there are unnecessarily constructive reinforcements, sounds tend to interfere. The present system provides a purer sound in which as many parts as possible vibrate at the same frequency.

The invention is also designed so that individual components can be machined separately, reducing costs and increasing consistency of the guitars.

DESCRIPTION OF THE PREFERRED EMBODIMENT

Figure 1:
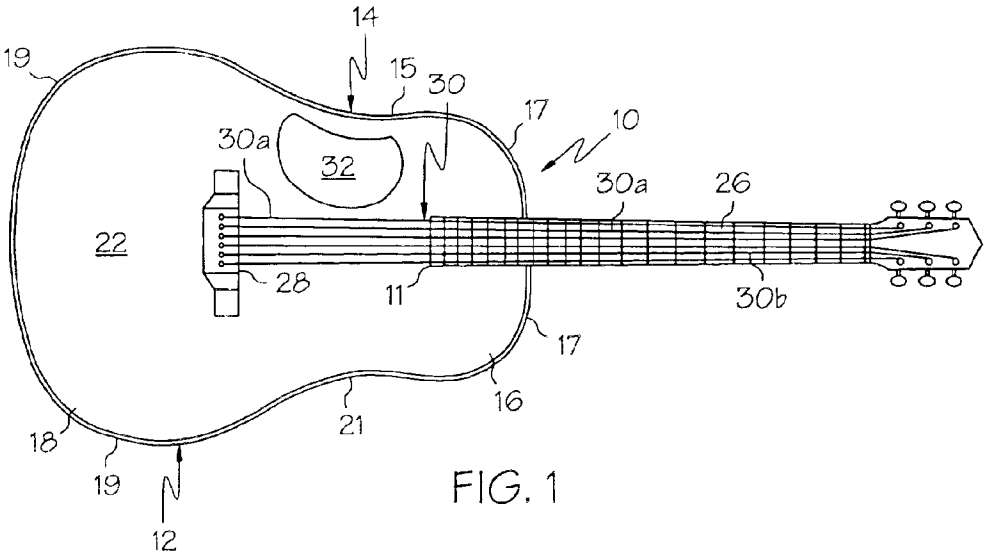
FIG. 1 is a top view of an acoustic guitar according to the invention.

While this invention may be embodied in many different forms, there are shown in the drawings and described in detail herein specific embodiments of the invention. The present disclosure is an exemplification of the principles of the invention and is not intended to limit the invention to the particular embodiments illustrated.

For the purposes of this disclosure, unless otherwise indicated, identical reference numerals used in different figures refer to the same component.

This invention relates to a bracing system in instruments using sound boxes. For purposes of description, an acoustic guitar is used for illustrative purposes. As shown in FIG. 1, guitars such as the one generally indicated at 10 having a hollow guitar body or sound box 12. Body 12 has a waist generally indicated at 14 which identifies the narrowest portion or mid-section of the guitar. The portion of the guitar body above waist 14 is known as the upper bout and is generally designated in the Figure at 16. The portion of the guitar body below waist 14 is generally known as the lower bout and is generally designated in the Figure at 18.

The top, 22, seen in FIG. 1 of guitar hollow body of sound box 12 is known as the sound board 22. The sound board 22 has a sound hole 32 and at its periphery, defines the edges of the upper bout 17, the lower bout 19 and the edges of upper 15 and lower 21 waist portions. The edges of the sound board 22 are connected to a side panel or wall and in turn the rear panel or bottom to form the hollow body as is typical of guitars. As is conventional in guitars, a neck 26 is attached to hollow body 12 to extend over sound board 22 as shown. A bridge 28 is also anchored to sound board 22 to transfer vibrations into the sound board. Strings generally designated 30, including bass strings 30*a,* which are closest to the upper edge 15 of the waist, and treble strings 30*b,* which are closest to the lower edge 21 of the waist, extend along neck 26 and are received by bridge 28, thereby supporting strings 30 over sound board 22. Strings 30 are attached at the distal end of the neck 26 in any conventional manner known in the art, preferably in such a way to allow for tension adjustment of the strings.

Figure 2:
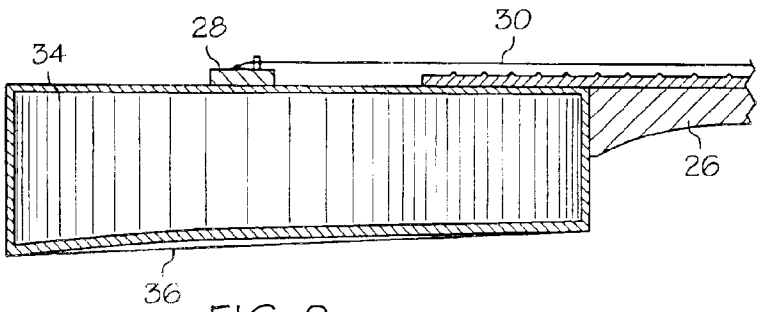
FIG. 2 is a side view of the sound box portion of the guitar.
Figure 3:
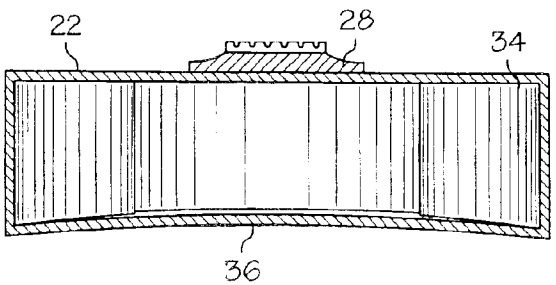
FIG. 3 is an end view of the sound box portion of the guitar.

FIGS. 2 and 3 illustrate a side view and an end view of the side board 34 having a top sound board 22 and a bottom board 36. The side board or wall 34 is typically one piece shaped to form the side of the body 12. The general sound box is well known.

Figure 4:
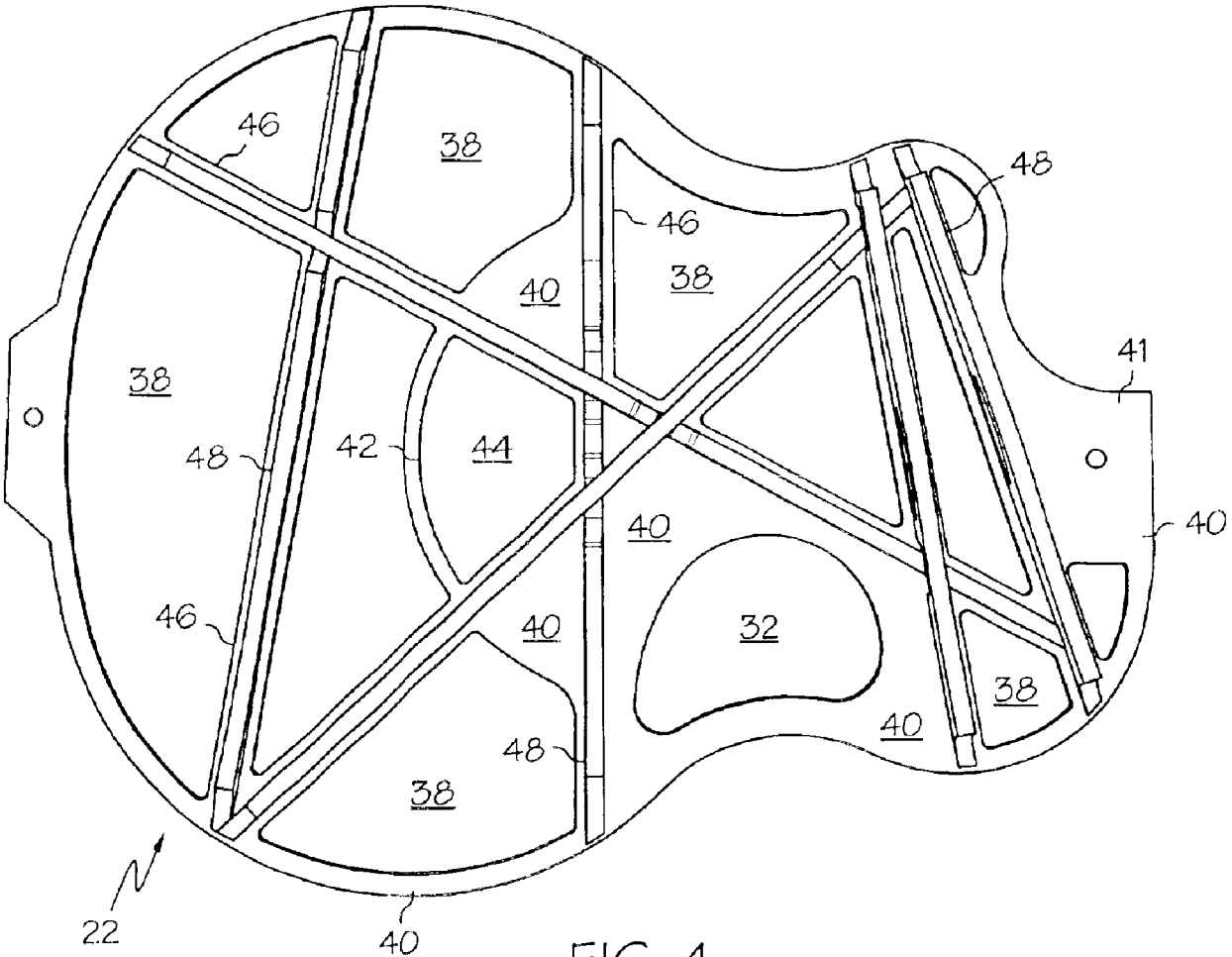
FIG. 4 is a face view of the inner side of the sound board of the guitar.

The present invention is directed to the sound box or the body 12, among other things the bracing system. FIG. 4 shows a face view of the bottom or underside of the sound board or top 22. The sound board may be made of multiple layers, however only one layer may be used. It should be understood that one may do the following described machining steps into the one layer embodiment. In the embodiment shown, a top board (first layer 38) is laminated with an additional layer to form a second layer 40. The additional layer preferably has its grain oriented substantially 90° to the first layer 38. Certain portions of the sound board 22 are machined down to the first layer 38. Not all the first layer portions 38 are indicated, but are clearly identifiable. The second layer 40 has portions which have been machined through to layer 38, while other portions are only partially machined or remain their original thickness. Not all the second layer portions 40 are indicated, but are clearly identifiable. A laminate bracing pattern may be seen when the sound board is machined. The machined areas are not required to be as shown.

Portion 42 of the second layer may be machined and replaced with an insert 44, shown as the darker material, to increase the stiffness of the region to support the bridge 28, which is attached to the top of the sound board 22. Suitable material for insert 44 comprises a material of higher modulus than the second layer 40. Suitable materials include, but are not limited to, maple, ebony rosewood and other woods possessing similar physical properties. This portion 42 may also remain unmachined, leaving the second layer 40 in place instead of using an insert.

Figure 6:
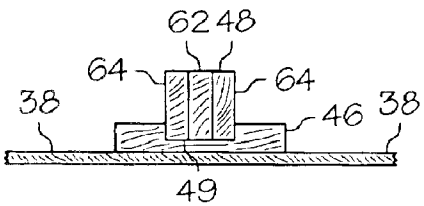
FIG. 6 is a cross section view at the point indicated in FIG. 5.
Figure 5:
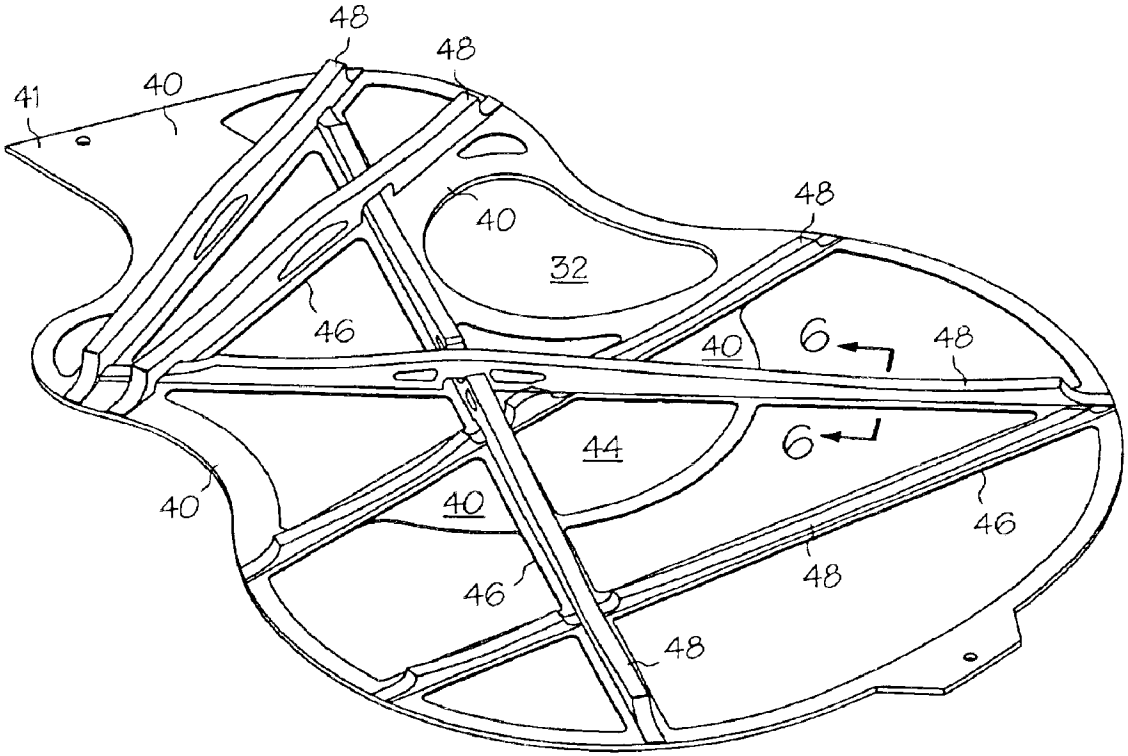
FIGS. 5 and 7–9 show various elevated side views of the underside of the sound board of the guitar from different perspectives.
Figure 7:
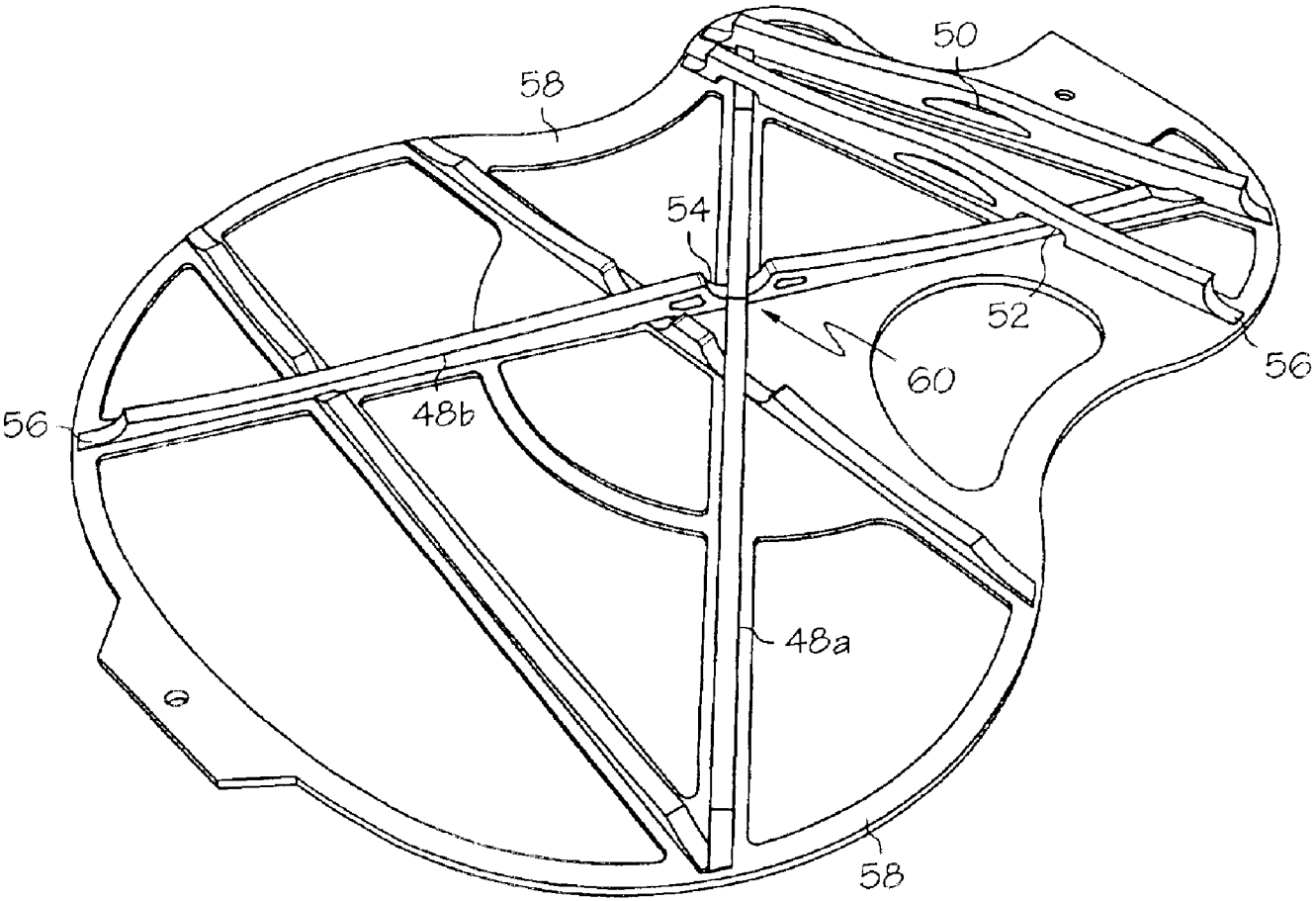
Figure 8:
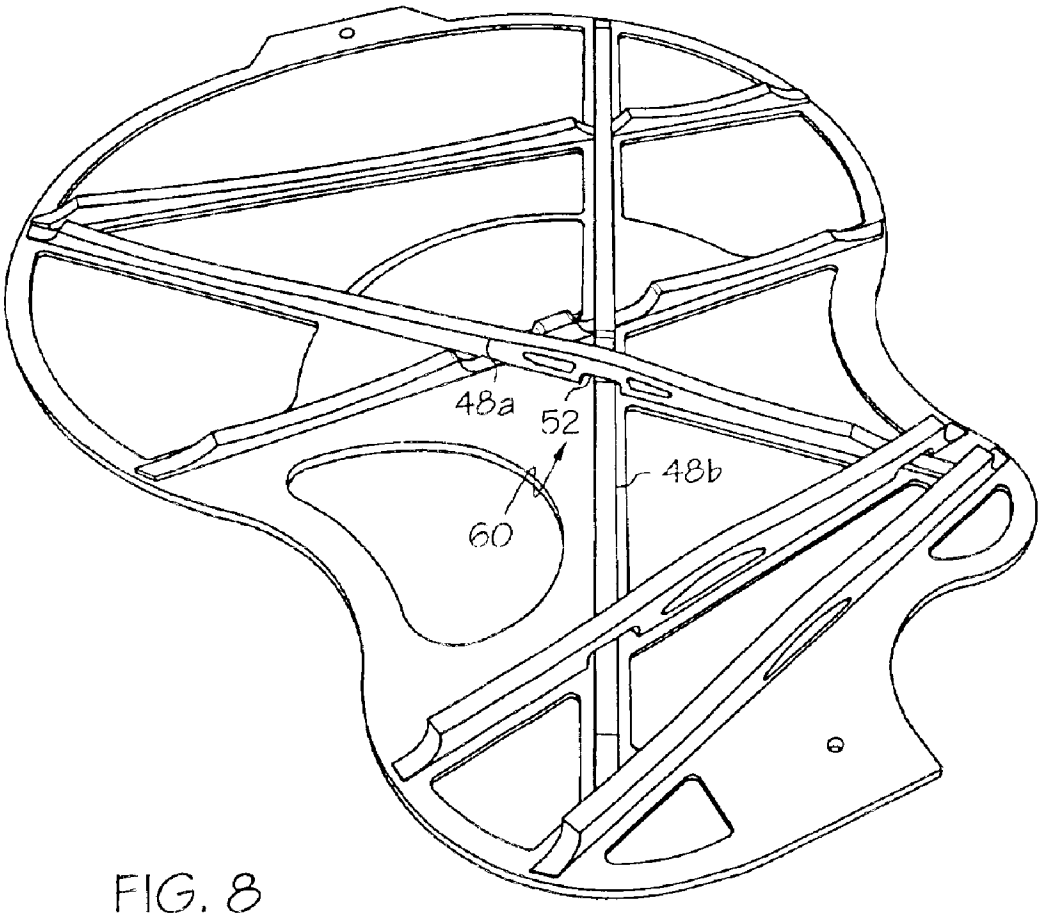

The second layer 40 is left to form the bracing pattern or in the form of bracing tracks 46 for the braces 48. The tracks 48 may have grooves 49, as seen in FIG. 6, which is a cross-section of a track shown in FIG. 5 having a brace positioned thereon, to fittingly receive the braces 48. The grooves are sized for the elongated braces 48 to fit therein for a more secure fit. Typically, the braces 48 are adhered into the grooves. The grooves 49 may be machined into the tracks 46. The grooves 49 may vary in depth, however it is preferable that the grooves 49 are not made beyond the depth of the second layer 46, as shown in FIG. 6. This allows the braces to act bigger than they are. The grooves also allow for greater surface area for adhesive to secure the braces 48. The braces become more a part of the board than extension of it. These grooves also apply to the brace patterns on the bottom board and optionally the struts on the side wall.

The second layer 40 also remains around the neck block area 41, the sound hole 32 and the brace 28 area for greater support in those areas.

Although the thicknesses of the materials may vary, suitably layer 38 may have an initial thickness of approximately 0.125 inch, which layer 40 may have an initial thickness closer to 0.0625 inch.

Although the types of wood may vary, suitably layer 38 is made of cedar, redwood, sitka spruce or ingleman spruce and layer 40 is made of sitka spruce, cedar or maple or other woods of similar mechanical properties.

FIGS. 5 and 7–9 show various elevated side views from different perspectives of the inner side of the sound board 22 in order to better see the bracing system. In one embodiment, for the sound board and/or the bottom board 36, the braces are neither parallel nor perpendicular to one another. The individual braces 48 are generally continuous from their individual origination points at the edge of the sound board to their ending points at the respective opposite edge of the sound board 22. The braces 48 have varying heights and are provided with elongated apertures 50 in the areas of greater heights. Due to the increase in height, the apertures 50 do not compromise the strength of the braces according to the engineering equation I=bh3/12. As such, the braces may be lightened without sacrificing strength. Changing the profiles of the braces 48 creates more stiffness where loads are greater. An example brace 48 may be seen in FIG. 10. It should be understood that the braces 48 have different configurations as needed for there positioning on the boards.

Certain braces are also provided with tunnels 52 and certain braces are provided with valleys 54, which extend through the tunnels 52. These valleys 54 and tunnels 52 allow the braces 48 to continue uninterrupted when they cross one another. An example of this can be seen, among other places, in FIG. 10 and FIGS. 7 and 8 where braces 48*a* and 48*b* cross at point 60. The valley 54 of brace 48*b* extends through the tunnel 52 of brace 48*a*. This configuration allows both braces 48*a* and 48*b* to cross without breaking either's continuation.

The braces 48 also slant downward at their termination points 56. Among other reasons, this is to accommodate the side wall 34, which is adhered to the periphery 58 of the top 22. As will be further described below with regard to the 3-D system, the braces and struts are not bonded together, rather that are immediately adjacent to one another. This configuration provides strength and rigidity without sacrificing the vibration capabilities throughout the sound box. There are no rigid glue joints involving the connection of the braces and struts to dampen the vibration effect.

The individual braces 48 may be made of a solid piece of wood, or other suitable material. However, the braces may also comprises center layer 62, seen as the darker wood, sandwiched between two outer layers 64, seen as the lighter wood. This brace configuration may be seen in many of the figures, but it is specifically pointed out in FIG. 10. Suitably the layers 62, 64 are adhered together. Center layer 62 is suitably made of a harder wood to help control stiffness, including, but not limited to, rosewood, mahogany or maple or other woods of similar stiffness. The outer layers 64 may comprise, but are not limited to, sitka spruce, mahogany or maple or other similar materials.

Figure 12:
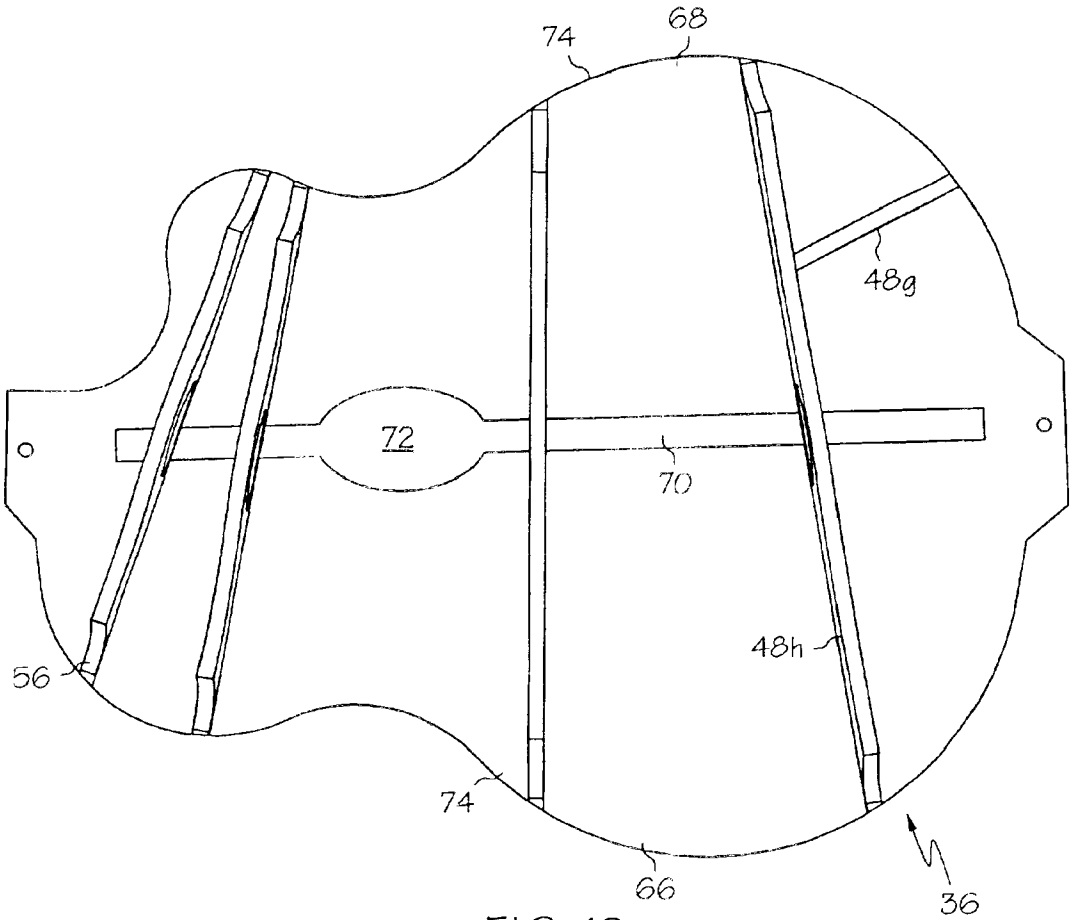
FIG. 12 is a face view of the inner side of the bottom board of the guitar.

FIG. 12 shows the bottom or back board 36 of the sound box 12. The inner side is shown. Although the bottom board 36 may be made of one piece of wood, or other suitable material, the presently shown bottom board 36 is made of a first panel 66 and a second panel 68, which are adhered together along line A, referred to as the spine. A generally flat brace 70 extends, suitably within a groove in the bottom 36, along the spine. This brace 70 is preferably adhered and provides additional connective support between the first and second panels 66, 68, in addition to longitudinal support for the bottom 36. Brace 70 may be widened at point 72 for extra support and strength, in addition to providing a suitable place for written material for identification, i.e. the owner or manufacturer.

The bottom 36 may be made of multiple layers, however only one layer of wood is shown. Suitable materials include, but are not limited to, rosewood, koa, black walnut, black acacia, maple, mahogany, zircote and macasser ebony. As with the sound board 22, the bottom 36 has grooves to fittingly receive the braces 48. The grooves are sized for the elongated braces 48 to fit therein for a more secure fit. Typically, the braces, which preferably are laminated pieces, 48 are adhered into the grooves. Although the thickness may very, preferably the total laminated width is from 0.25 to 0.375 inch. Although the wood types may vary, the laminated braces preferably are made of rosewood and sitka spruce or equivalent stiffness wood combinations.

Figure 13:
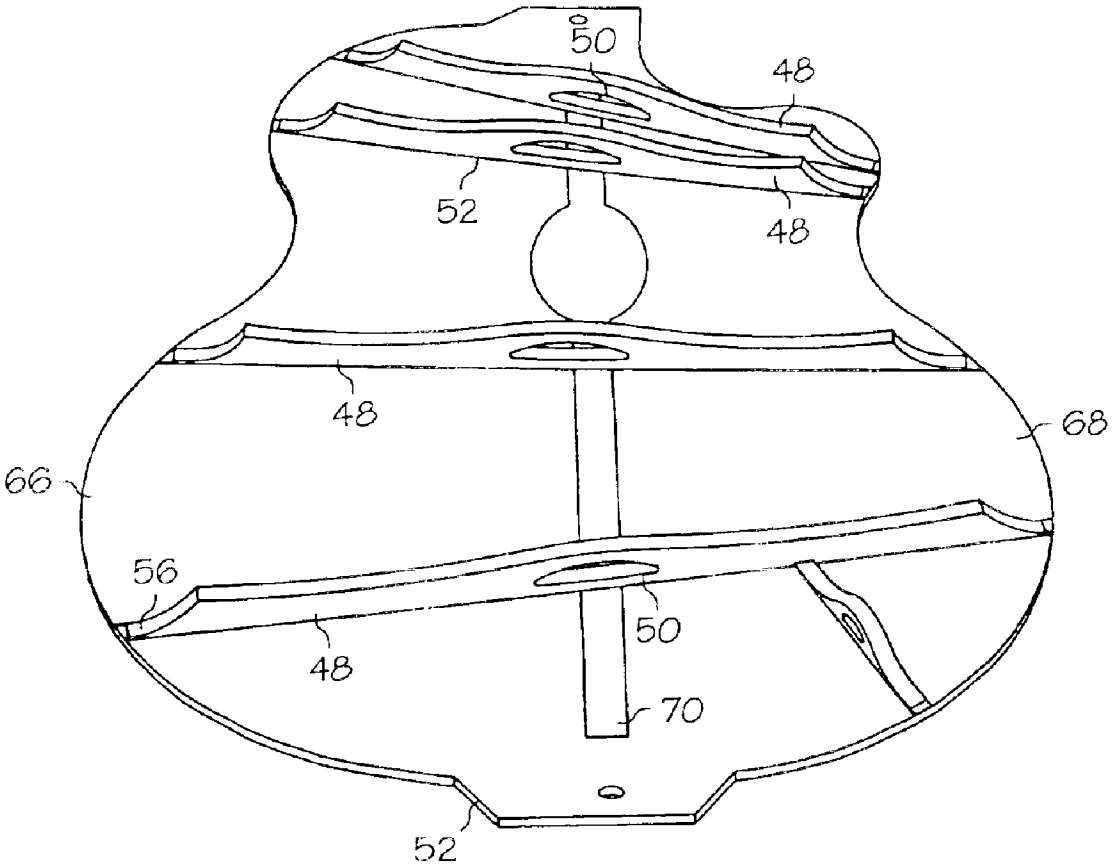
FIGS. 13 and 14 show various elevated side views of the inner side of the bottom board of the guitar from different perspectives.
Figure 14:
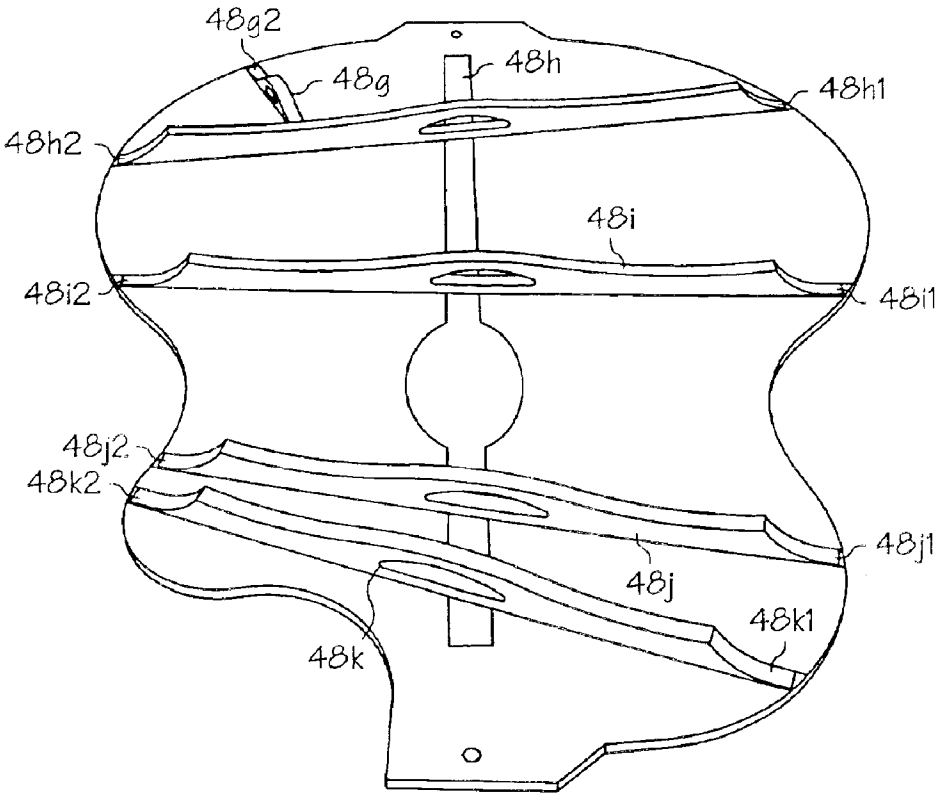

FIGS. 13 and 14 show various elevated side views from different perspectives of the inner side of the bottom board 36 in order to better see the bracing system attached to the bottom 36. In one embodiment, for the sound board and/or the bottom board 36, the braces are neither parallel nor perpendicular to one another. The individual braces 48 are generally continuous from their individual origination points at the edge of the bottom 36 to their ending points at the respective opposite edges of the bottom 36. The exception to this is brace 48*g*, which extends from brace 48*h* to the periphery of the bottom 36. As with the top 22, the braces 48 have varying heights and are provided with elongated apertures 50 in the areas of greater heights. Due to the increase in height, the apertures 50 do not compromise the strength of the braces according to the engineering equation I=bh3/12. As such, the braces may be lightened without sacrificing strength. Changing the profiles of the braces 48 creates more stiffness where loads are greater. An example brace 48 may be seen in FIG. 10. It should be understood that the braces 48 have different configurations as needed for there positioning on the boards.

Some of these braces 48 are also provided with shallow tunnels 52, through which the flat brace 70 extends. As such, the braces 48, 70 are able to continue uninterrupted when they cross one another. The braces 48 also slant downward at their termination points 56. Among other reasons, this is to accommodate the side wall 34, which is adhered to the periphery 74 of the bottom 36.

Again, the individual braces 48 may be made of a solid piece of wood, or other suitable material. However, the braces may also comprises center layer 62, seen as the darker wood, sandwiched between two outer layers 64, seen as the lighter wood. This brace configuration may be seen in many of the figures, and is further explained above with regard to the sound board 22.

Figure 11:
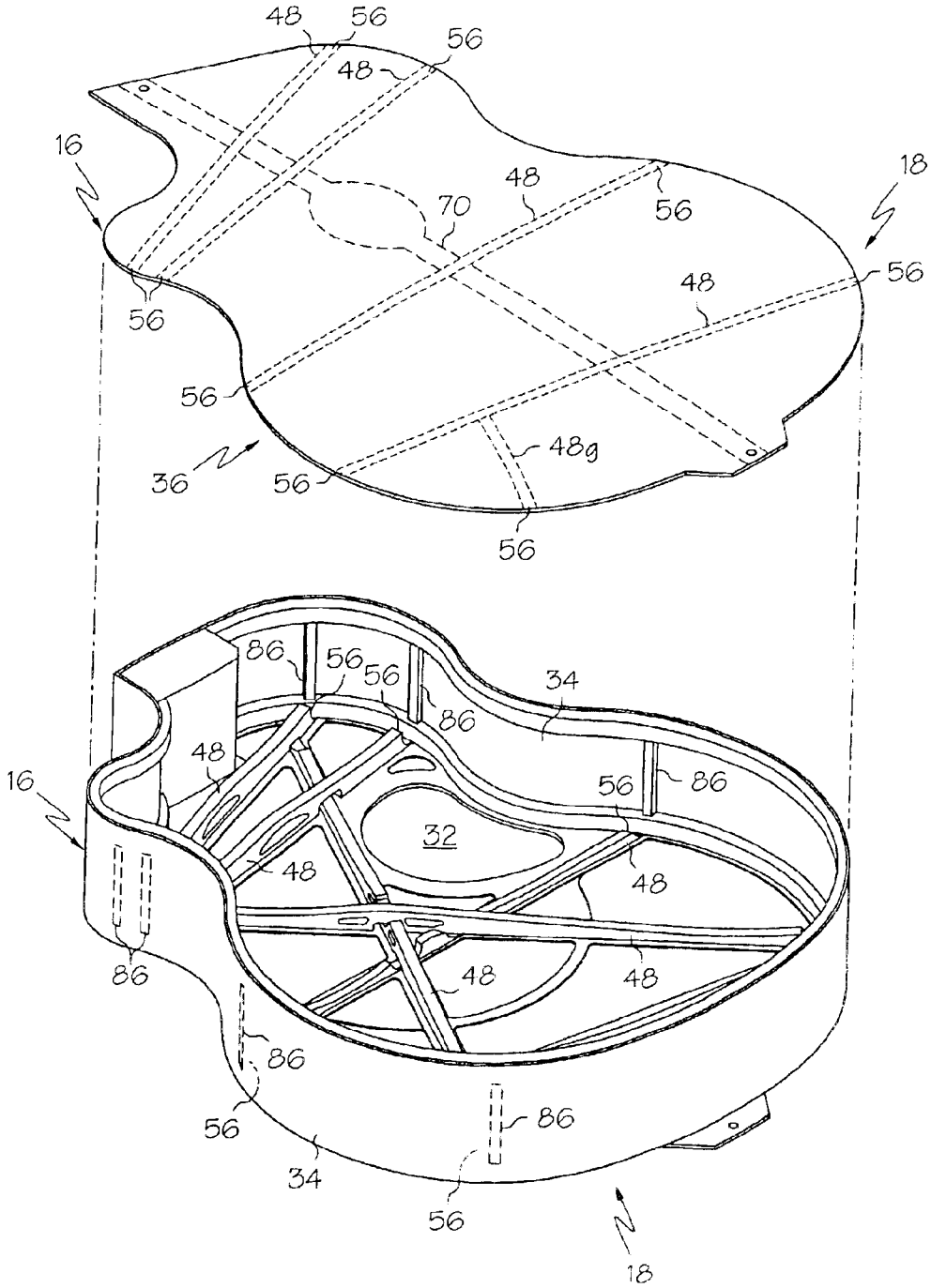
FIG. 11 is an exploded view of the sound box of the invention.

One should be aware that, as shown in FIG. 11 (elements which have not been described heretofore will be described below), when the face of the sound board 22 shown in FIG. 4 is placed over the face of the bottom 36 shown in FIG. 11, with the upper bouts 16 and the lower bouts 18 aligned, the termination points 56 of the braces 48 of the bottom 36, including one end of the shortened brace 48*g*, are aligned in opposing fashion with the termination points 56 of the braces 48 of the sound board 22. This is part of a 3-D bracing structure which is a feature of the invention.

Figure 9:
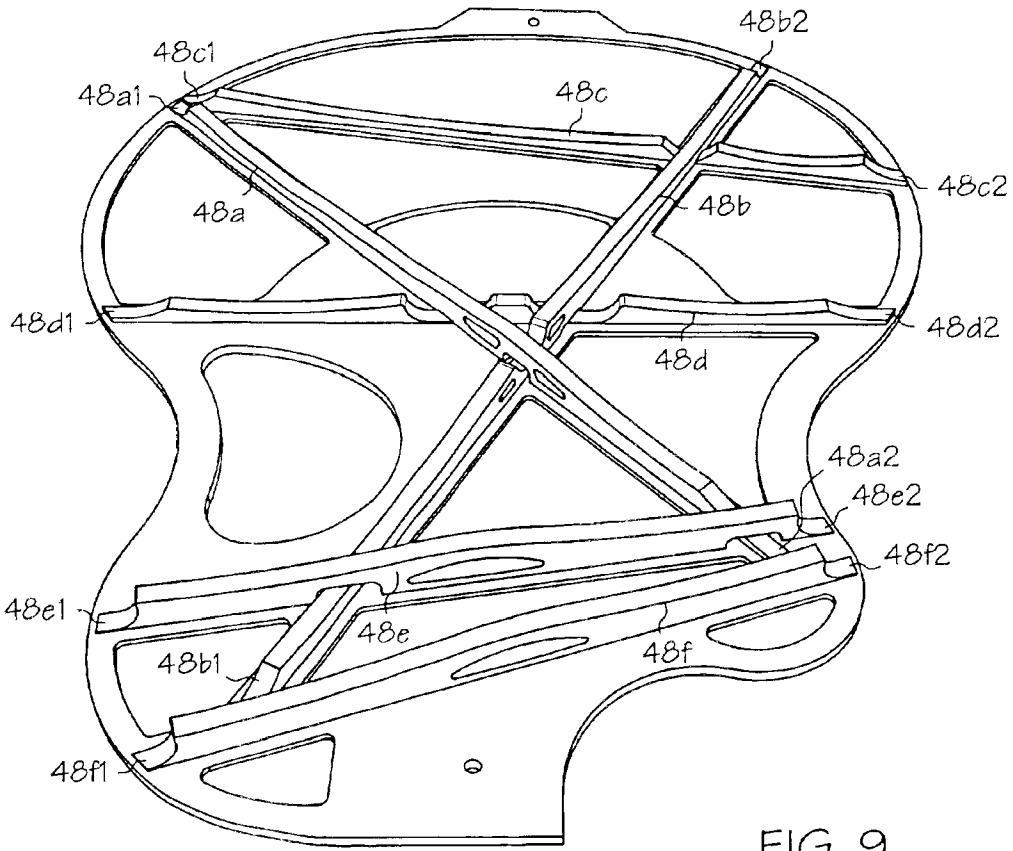
Figure 10:
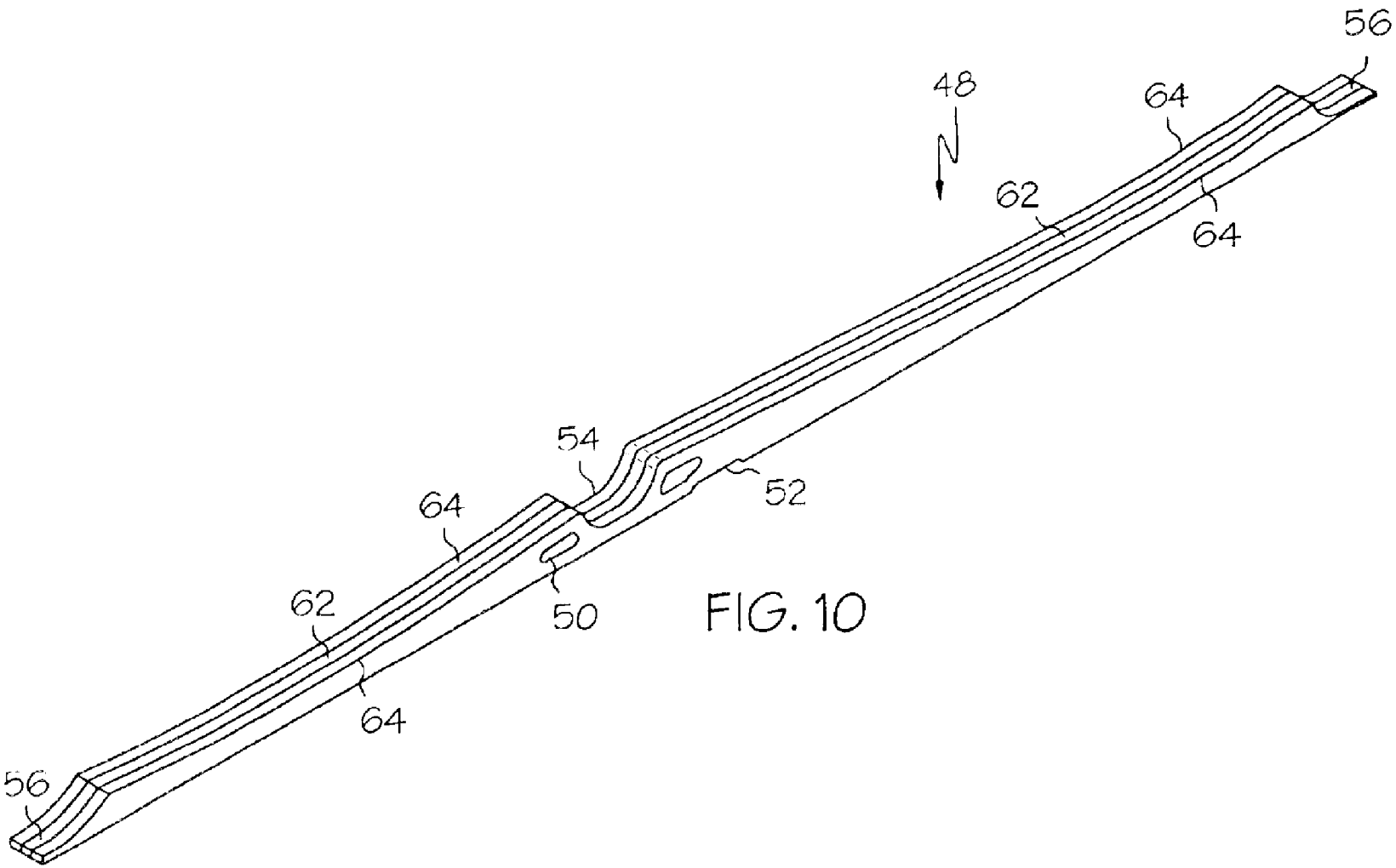
FIG. 10 is a perspective view of a brace.

This is also explained by viewing FIG. 9, showing a view of the sound board 22 bracing, and 14, showing a view of the bottom 36 bracing, in addition to FIG. 11. For illustrative purposes, the braces of the sound board 22 are labeled 48*a–f* and the braces of the bottom 36 are labeled 48*g–k*. As will be seen, more than one termination point of the sound board 22 may match up with a termination of a single brace of the bottom 36. Each brace has two termination points, which labeled (1) and (2). As such, brace 48*a* has termination points 48*a*1 and 48*a*2, as shown in FIG. 9. It should be understood that some termination points in the sound board 22, which are paired with another termination point, do not match up exactly with the opposing board's termination points. However, one of the paired termination points will match up better than the other termination point of a particular pair.

The matching termination points are shown below, listing the sound board 22 points first and the bottom 36 points second: 48*a*1 & 48*ci* with 48*h*1; 48*d*1 with 48*i*1; 48*e*1 with 48*j*1; 48*f*1 with 48*k*1; 48*a*2 & 48*f*2 with 48*k*2; 48*e*2 with 48*j*2; 48*d*2 with 48*i*2; 48*c*2 with 48*h*2; and 48*b*2 with 48*g*2. 48*a*1 and 48*ci* and 48*a*2 and 48*f*2 are paired because their respective termination points in each pair are sufficiently close enough together to be matched with a single termination point of a brace of the bottom 36.

Figure 15:
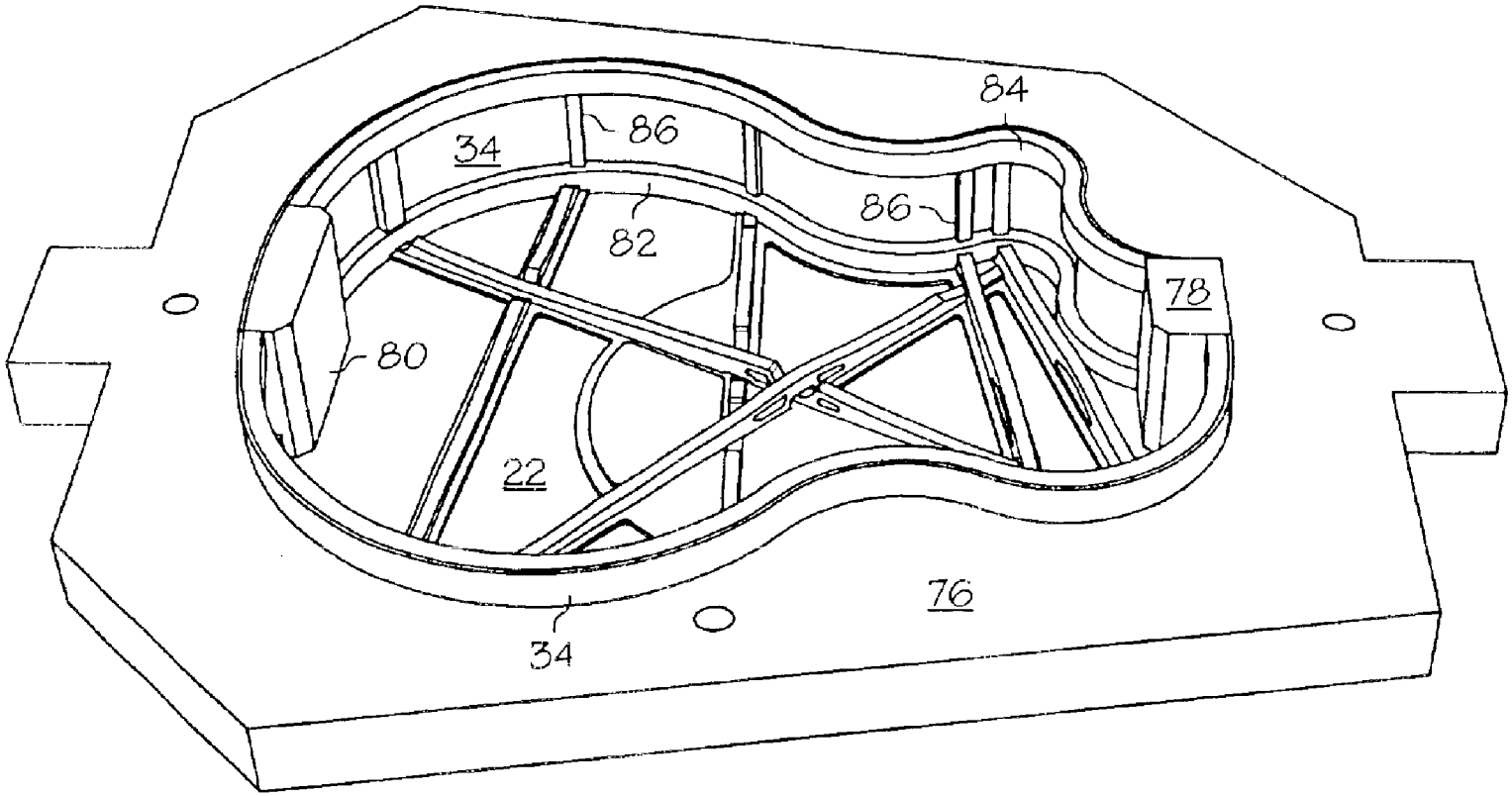
FIGS. 15 and 16 show various elevated side views of a partially constructed sound box of the guitar, including the sound board.
Figure 16:
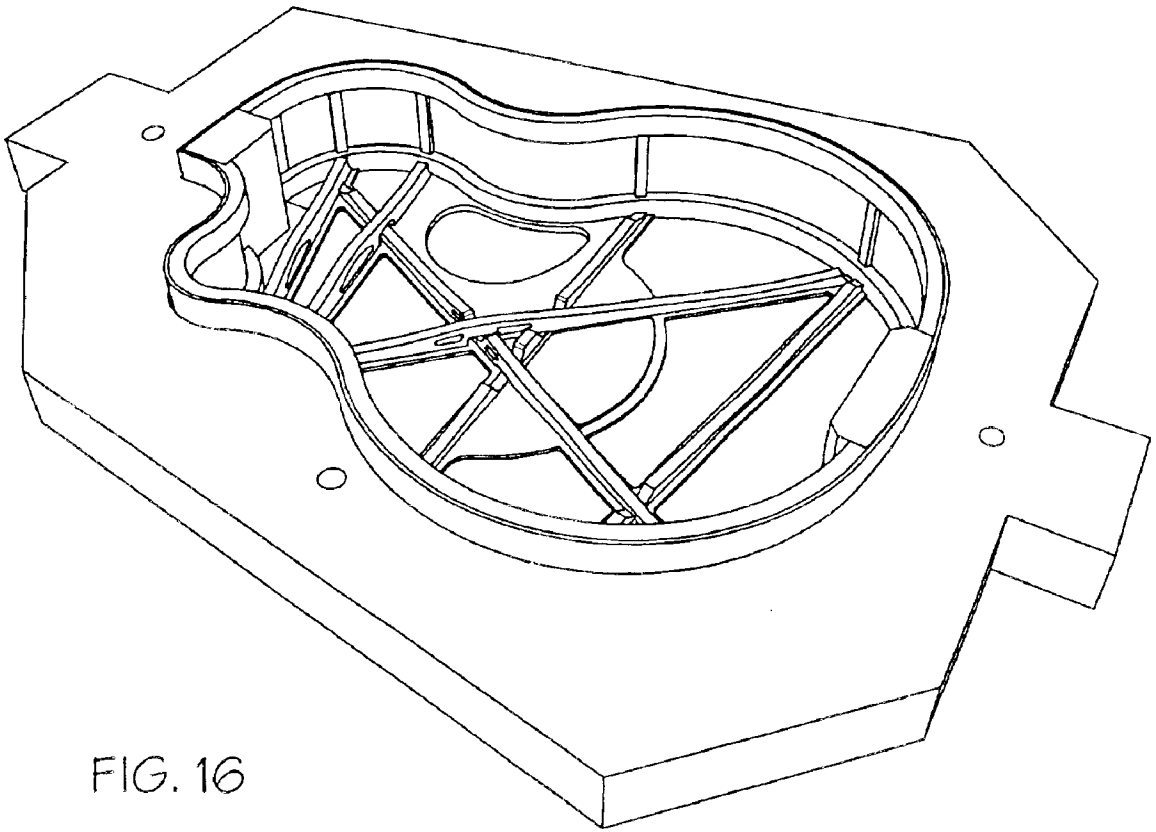

FIGS. 15 and 16 illustrate different views of the side wall 34 positioned for adherence onto the sound board 22. These figures clearly illustrate the structural relationship between the sound board 22 and the side wall 34 from the inside perspective. The structure is being held in a mold 76 to help maintain the shape of the side wall 34.

The side wall 34 extends around the periphery of the sound board 22. A neck block 78 is provided at one end for securement to the neck 26 and an end block 80 is provided at the other end. The blocks 78, 80 are used for connection purposes and for support of the overall structure of the sound box. Strips 82, 84, preferably wood strips, are attached, preferably adhered, the inside upper and lower edges of the side wall 34. The strips 82, 84 extend from block 78 to block 80. The strips 82, 84 provide support to the structure and provide greater surface area to connect, preferably adhere, to the sound board 22 and the bottom 36. The strips 82, 84 are scored, or cut, along their length to provide flexibility so that the strips can easily conform to the side wall 34 in its tortuous path.

The invention also provides vertical struts 86, preferably wooded, on the inside of the side wall 34. The struts 86 provide support to the sound box as well as providing a feature of the 3-D bracing system. As can be seen in FIGS. 15 and 16, the vertical struts are aligned with the termination points of the braces 48. The struts 86 rise vertically from the termination points of the braces 48.

Figure 17:
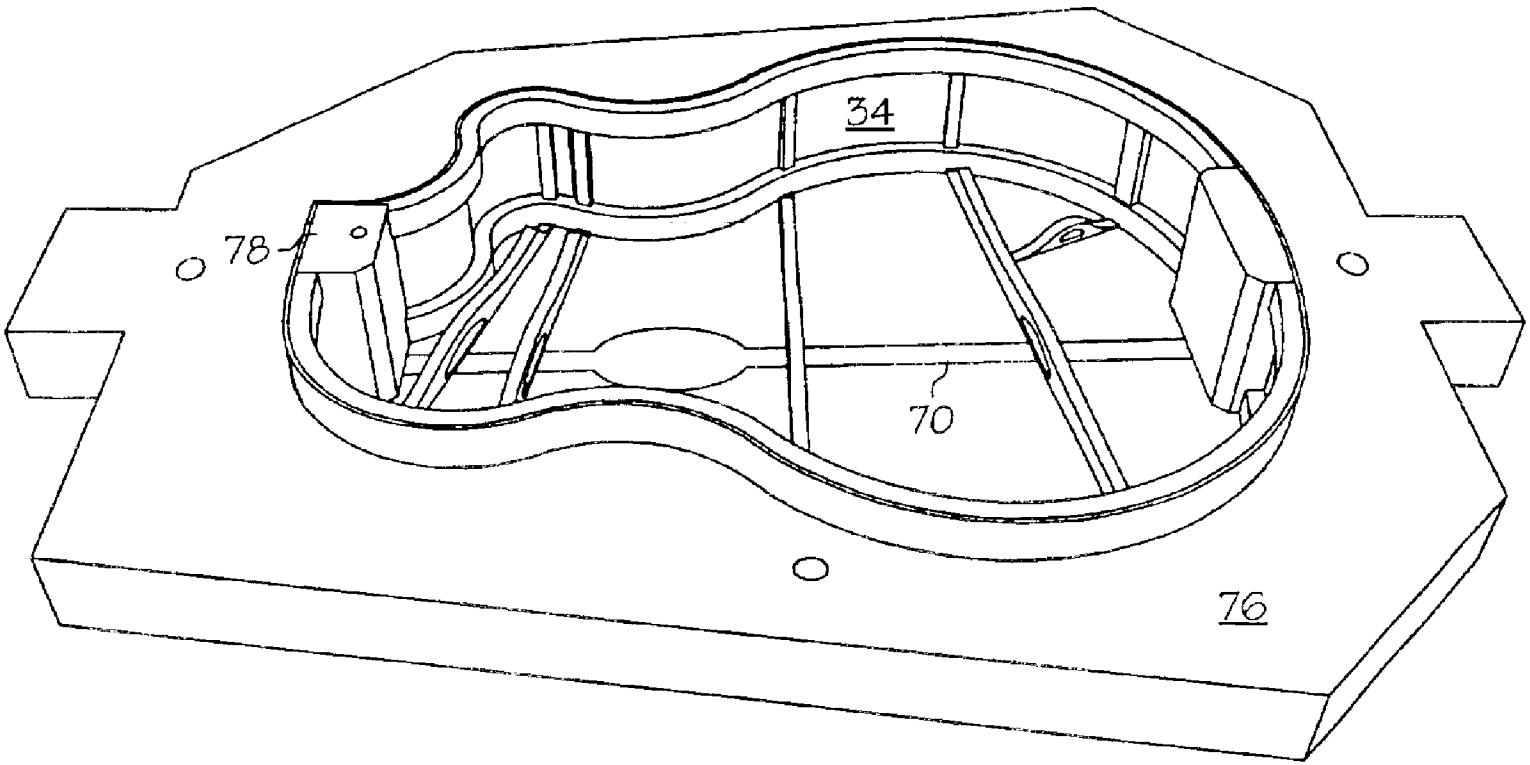
FIGS. 17 and 18 show various elevated side views of a partially constructed sound box of the guitar, including the bottom board.
Figure 18:
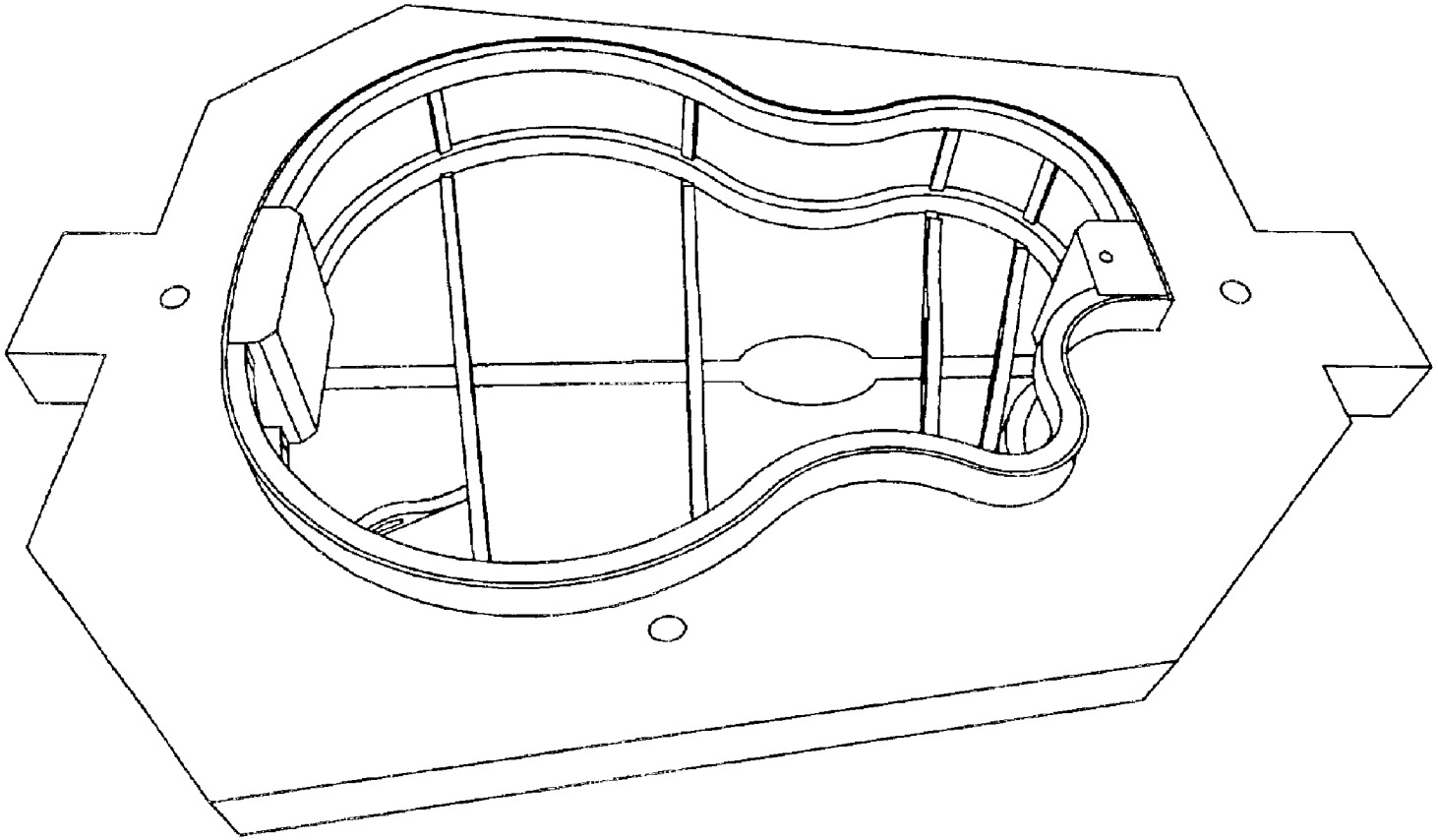

FIGS. 17 and 18 illustrate different views of the side wall 34 positioned for adherence onto the bottom 36. These figures clearly illustrate the structural relationship between the bottom board 36 and the side wall 34 from the inside perspective. The structure is being held in a mold 76 to help maintain the shape of the side wall 34.

The side wall 34 extends around the periphery of the bottom board 36. Again, the neck block 78 is provided at one end for securement to the neck 26 and an end block 80 is provided at the other end. Strips 82, 84 can also be seen from this angle.

As can be seen in the figures, specifically FIG. 11, the vertical struts are aligned with the termination points of the braces 48. The struts 86 rise vertically from the termination points of the braces 48. There are nine struts in this embodiment. It should be understood that the number of struts may be as many as needed. The struts may be made of any suitable material, preferably wood. The various struts and there positioning can clearly be seen in the figures.

As referred to above, the bracing system, in its complete form, create a 3-D bracing system. The 3-D bracing system is generally the bracing system of the sound board 22 and the bracing system of bottom board 36 interconnected by the struts 86 on the side wall 34. Although the complete 3-D system is not shown, in addition to viewing FIG. 11 one can easily picture the complete system by placing the bottom board 36 over the partially assembled sound box shown in FIGS. 15 and 16. In reverse, the complete system may be pictured by placing the sound board 22 over the partially assembled sound box shown in FIGS. 17 and 18.

As mentioned above, when the sound box is assembled, the termination points 56 of the sound board 22 are generally above the corresponding termination point 56 of the bottom board 36. The corresponding points 56 are linked by the struts to create the 3-D bracing system. As mentioned above, pairs of braces in the sound board 22 may terminate in approximately the same position. Further, as mentioned above, the abbreviated brace 48*g* provides only one termination point 56 at the periphery of the bottom board 36.

A particular, but not the exclusive, feature of the 3-D bracing system is the ability of the interconnection of the braces via the struts to disperse stress and strain throughout the system. The positioning and the configuration of the braces 48 and struts 86 provide strength and stiffness for the sound box without adding unnecessary weight, while providing for uniformity of vibration and pureness of sound.

Other documents and features incorporated in this application include U.S. Pat. No. 6,060,650, U.S. application Ser. No. 09/852,253 and U.S. application Ser. No. 09/567,145.

In addition to being directed to the embodiments described above and claimed below, the present invention is further directed to embodiments having different combinations of the dependent features described above and/or claimed below.

Every patent, application or publication mentioned above is herein incorporated by reference.

The invention contemplates any combination of the above described elements of the stringed instrument. Therefore, it should be understood that multiple inventions are disclosed herein.

The above examples and disclosure are intended to be illustrative and not exhaustive. These examples and description will suggest many variations and alternatives to one of ordinary skill in this art. All these alternatives and variations are intended to be included within the scope of the claims, where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each single dependent claim format which creates a dependency from a prior antecedent-possessing claim other than the specific claim listed in such dependent claim below (e.g. claim 6 may be taken as alternatively dependent from any of claims 2–5, claim 4 may be taken as alternatively dependent from claim 3; etc.).

What is claimed is as follows:

1. A stringed instrument comprising, a sound box defining an inner space, the sound box comprising a bottom board, a sound board and a side wall, the bottom board, sound board and side wall each having an inner surface which faces the inner space, the side wall being between the bottom board and the sound board, wherein the bottom board and the sound board each have an periphery and the side wall has an upper periphery and a lower periphery, the periphery of the sound board being connected to the upper periphery and the periphery of the bottom board being connected to the lower periphery, the sound board comprising a plurality of elongated braces facing the inner space, the braces having a length, a thickness and a height, the height being relative to the inner surface of the sound board, wherein the height of the braces varies along their lengths and wherein at least two braces cross, the crossing braces defining an intersection between the two braces, wherein at the intersection a valley is formed in one brace and a tunnel is formed in the other brace, the two braces being independent from one another, such that moment forces, which are in or parallel to the plane of the sound board, are not transferred there between.

2. The stringed instrument of claim 1, the braces having a first end and a second end, wherein the first ends and the second ends of the braces are each positioned substantially adjacent to the periphery of the sound board and wherein the braces are continuous from their first ends to their second ends.

3. The stringed instrument of claim 1, wherein the braces have transverse apertures.

4. The stringed instrument of claim 1, wherein the braces comprises at least two layers of material.

5. The stringed instrument of claim 4, wherein one of the at least two layers of material is harder than another one of the at least two layers.

6. The stringed instrument of claim 5, wherein the braces comprise three layers of material, each layer being perpendicular to the inner surface of the sound board, wherein the one layer is between the other two layers and wherein the one layer is harder than the other two layers.

7. The stringed instrument of claim 1, wherein there are at least five braces attached to the sound board and wherein each of the at least five braces crosses another brace.

8. The stringed instruments of claim 1, wherein the inner surface of the sound board comprises grooves which fittingly receive the braces.

9. The stringed instrument of claim 1, wherein the sound board comprises a first layer superimposed on a second layer, wherein the first layer faces the inner space, wherein portions of the first layer are removed.

10. The stringed instrument of claim 9, wherein portions of the second layer of the sound board are exposed to the inner space.

11. The stringed instrument of claim 10, wherein a centrally located portion of the first layer is removed and replaced with a similarly shaped piece of a hard material, wherein the hard material is harder that the first or second layer.

12. The stringed instrument of claim 10, further comprising a sound hole in the sound board, wherein the second layer of the sound board is present adjacent the sound hole.

13. The stringed instrument of claim 10, wherein a margin comprising the first and second layers is formed around the periphery of the sound board.

14. The stringed instrument of claim 10, wherein a majority of the inner surface of the sound board exposes the second layer to the inner space.

15. The stringed instrument of claim 10, wherein braces are attached to the first layer.

16. The stringed instrument of claim 15, wherein the first layer comprises grooves which fittingly receive the braces.

17. The stringed instrument of claim 2, the bottom board comprising a plurality of elongated braces facing the inner space, wherein the braces having a length, a thickness and a height, the height being relative to the inner surface of the sound board, wherein the height of the braces varies along their lengths.

18. The stringed instrument of claim 17, the bottom board braces having a first end and a second end, wherein the first ends and the second ends of the bottom board braces are each positioned substantially adjacent to the periphery of the bottom board and wherein the bottom board braces are continuous from their first ends to their second ends.

19. The stringed instrument of claim 17, wherein the bottom board braces have transverse apertures.

20. The stringed instrument of claim 17, wherein the bottom board braces comprise at least two layers of material.

21. The stringed instrument of claim 20, wherein one of the at least two layers of material of the bottom board braces is harder than another one of the at least two layers.

22. The stringed instrument of claim 21, wherein the bottom board braces comprise three layers of material, each layer being perpendicular to the inner surface of the bottom board, wherein the one layer is between the other two layers and wherein the one layer is harder than the other two layers.

23. The stringed instrument of claim 17 wherein there are at least four braces attached to the bottom board and wherein each of the at least four braces crosses another bottom board brace.

24. The stringed instruments of claim 17, wherein the inner surface of the bottom board comprises grooves which fittingly receive the braces.

25. The stringed instrument of claim 17, wherein the bottom board comprises only one layer.

26. The stringed instrument of claim 25, wherein the bottom board comprises two layers of wood joined together.

27. The stringed instrument of claim 26, further comprising a spine, which is contact with both layers of wood.

28. The stringed instrument of claim 27, wherein the spine crosses the bottom board braces.

29. The stringed instrument of claim 18, wherein each of the bottom board braces mirror a sound board brace in positioning and length.

30. The stringed instrument of claim 29, further comprising a plurality of struts attached to the inner surface of the side wall the struts being generally perpendicular with the sound board, the struts have first ends and second ends.

31. The stringed instrument of claim 30, wherein the first ends of the struts are adjacent to an end of a sound board brace and wherein the second ends of the struts are adjacent to an end of a bottom board brace.

32. The stringed instrument of claim 1, wherein the sound board and the bottom board are made of different types of wood.

33. The stringed instrument of claim 1, wherein the braces are not parallel to one another.

34. The stringed instrument of claim 17, wherein no bottom brace is parallel with another bottom brace.

35. The stringed instrument of claim 17, wherein no sound board brace is parallel with another sound board brace.

36. A stringed instrument comprising, a sound box defining an inner space, the sound box comprising a bottom board, a sound board and a side wall, the bottom board, sound board and side wall each having an inner surface which faces the inner space, the side wall being between the bottom board and the sound board, wherein the bottom board and the sound board each have an periphery and the side wall has an upper periphery and a lower periphery, the periphery of the sound board being connected to the upper periphery and the periphery of the bottom board being connected to the lower periphery, the sound board comprising a plurality of elongated braces facing the inner space, wherein the braces having a length, a thickness and a height, the height being relative to the inner surface of the sound board, the braces having a first end and a second end, wherein the first ends and the second ends of the braces are each positioned substantially adjacent to the periphery of the sound board and wherein the braces are continuous from their first ends to their second ends, the bottom board comprising a plurality of elongated braces facing the inner space, wherein the braces a length, a thickness and a height, the height being relative to the inner surface of the sound board.

37. The stringed instrument of claim 36, the braces having at least two layers, wherein one of the at least two layers of material is harder than another one of the at least two layers.

38. The stringed instrument of claim 36, the bottom board braces having a first end and a second end, wherein the first ends and the second ends of the bottom board braces are each positioned substantially adjacent to the periphery of the bottom board and wherein the bottom board braces are continuous from their first ends to their second ends.

39. The stringed instrument of claim 36, wherein the sound board braces have transverse apertures.

40. The stringed instrument of claim 38, wherein each of the bottom board braces mirror a sound board brace in positioning and length.

41. The stringed instrument of claim 40, further comprising a plurality of struts attached to the inner surface of the side wall the struts being generally perpendicular with the sound board; the struts have first ends and second ends.

42. The stringed instrument of claim 41, wherein the first ends of the struts are adjacent to an end of a sound board brace and wherein the second ends of the struts are adjacent to an end of a bottom board brace.

43. The stringed instrument of claim 36, wherein the braces are not parallel to one another.

44. The stringed instrument of claim 36, wherein no bottom brace is parallel with another bottom brace.

45. The stringed instrument of claim 34, wherein no sound board brace is parallel with another sound board brace.

* * * * *